US007632162B2

(12) United States Patent
Ozaki et al.

(10) Patent No.: US 7,632,162 B2
(45) Date of Patent: Dec. 15, 2009

(54) PERSONAL WATERCRAFT WITH ENGINE HAVING EXHAUST COLLECTING SYSTEM

(75) Inventors: Atsufumi Ozaki, Kobe (JP); Yasuo Okada, Akashi (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 151 days.

(21) Appl. No.: 11/899,975

(22) Filed: Sep. 6, 2007

(65) Prior Publication Data

US 2008/0057803 A1 Mar. 6, 2008

(30) Foreign Application Priority Data

Sep. 6, 2006 (JP) ..... 2006-241810

(51) Int. Cl.
*F02B 61/04* (2006.01)

(52) U.S. Cl. ..... 440/89 C; 440/88 J

(58) Field of Classification Search ..... 440/89 R, 440/89 C, 89 J, 89 B; 60/313, 323
See application file for complete search history.

(56) References Cited

U.S. PATENT DOCUMENTS 5,010,731 A * 4/1991 Onishi ..... 60/313
5,997,373 A * 12/1999 Asai et al. ..... 440/89 R
6,478,645 B1 * 11/2002 Allbright et al. ..... 440/89 R

FOREIGN PATENT DOCUMENTS

JP 2000-345873 12/2000

* cited by examiner

*Primary Examiner*—Ed Swinehart
(74) *Attorney, Agent, or Firm*—Alleman Hall McCoy Russell & Tuttle LLP

(57) ABSTRACT

In a personal watercraft equipped with a multi-cylinder engine including an exhaust collecting system configured to discharge an exhaust gas from the engine, the exhaust collecting system comprising a plurality of exhaust passages respectively corresponding to a plurality of cylinders provided in the multi-cylinder engine, an exhaust collecting passage which is located downstream of the plurality of exhaust passages in a flow direction of the exhaust gas and is configured to collect the plurality of exhaust passages, a water jacket formed at an outer peripheral region of each of the plurality of exhaust passages, for cooling the exhaust gas flowing in the exhaust passages, and a connecting passage configured to connect at least two of the plurality of exhaust passages.

10 Claims, 13 Drawing Sheets

PERSONAL WATERCRAFT WITH ENGINE HAVING EXHAUST COLLECTING SYSTEM

TECHNICAL FIELD

The present invention relates to a personal watercraft which is configured to be driven to travel by a multi-cylinder engine comprising an exhaust collecting system which includes a plurality of exhaust passages respectively corresponding to a plurality of cylinders provided in the multi-cylinder engine and an exhaust collecting passage which is located downstream of the plurality of exhaust passages in a flow direction of an exhaust gas and is configured to collect the plurality of exhaust passages, and which is configured to discharge the exhaust gas emitted from the plurality of cylinders through the plurality of exhaust passages and then through the exhaust collecting passage.

BACKGROUND

In recent years, so-called jet-propulsion personal watercraft have been widely used in leisure, sport, rescue activities, and the like. Personal watercraft are generally configured to have a propulsion pump which is a propulsion device that pressurizes and accelerates water sucked from a water intake provided on a hull bottom surface and ejects it rearward from an outlet port. As a result, the personal watercraft is propelled.

In the jet-propulsion personal watercraft, a steering nozzle provided behind the outlet port of the propulsion pump is pivoted either to the right or to the left, to change the ejection direction of the water from rearward to the right or to the left, thereby turning the watercraft to the right or to the left.

The personal watercraft which is represented by the above jet-propulsion personal watercraft is typically equipped with a multi-cylinder engine configured to drive a propulsion device such as the propulsion pump.

In the above personal watercraft, the water intake of the propulsion pump is sometimes exposed in air for a moment while the watercraft is skipping on water waves. In this case, a load applied to the engine is significantly reduced for a moment, causing an over revolution of the engine. The over revolution is unfavorable to the engine. To avoid occurrence of the over revolution of the engine, some personal watercraft are equipped with an over revolution inhibiting system configured to omit both of or either one of fuel feeding and ignition, as disclosed in Japanese Laid-Open Patent Application Publication No. 2000-345873.

However, if the over revolution inhibiting system equipped in the personal watercraft is activated, uncombusted gas is sometimes left in a muffler of an exhaust system of the engine. The uncombusted gas left in the muffler may be combusted, causing an "after fire."

Undesirably, the after fire generates a large noise and applies an unwanted pressure to the muffler and to the exhaust system of the engine.

SUMMARY OF THE INVENTION

The present invention addresses the above described conditions, and an object of the present invention is to provide a personal watercraft which is equipped with a multi-cylinder engine which is capable of substantially inhibiting occurrence of after fire.

According to the present invention, there is provided a personal watercraft equipped with a multi-cylinder engine including an exhaust collecting system configured to discharge an exhaust gas from the engine, the exhaust collecting system comprising a plurality of exhaust passages respectively corresponding to a plurality of cylinders provided in the multi-cylinder engine; an exhaust collecting passage which is located downstream of the plurality of exhaust passages in a flow direction of the exhaust gas and is configured to collect the plurality of exhaust passages; a water jacket formed at an outer peripheral region of each of the plurality of exhaust passages, for cooling the exhaust gas flowing in the exhaust passages; and a connecting passage configured to connect at least two of the plurality of exhaust passages.

In accordance with the personal watercraft configured as described above, the connecting passage is formed to connect the exhaust passages provided at outer peripheries thereof with the water jackets for cooling the exhaust gas flowing therein. With this construction, in cases where the uncombusted gas is left in an exhaust passage, it is combusted relatively slowly with a flame in the exhaust gas which is propagated to the exhaust passage via the connecting passage from another exhaust passage corresponding to a cylinder in which ignition takes place subsequently. For this reason, the uncombusted exhaust gas is substantially prevented from flowing into the water muffler located on a downstream side of the exhaust collecting system, and as a result, after fire is less likely to occur. In addition, since the quantity of uncombusted gas in the exhaust gas emitted from the exhaust collecting system is reduced, a cleaner exhaust gas is generated.

The plurality of exhaust passages may be arranged in close proximity with each other at downstream end portions thereof, and the connecting passage may be comprised of a groove formed on a first joint face of the plurality of exhaust passages formed at the downstream end portions thereof or a second joint face joined to the first joint face. The connecting passage may be manufactured by casting, by using a mold formed with a convex portion corresponding to the groove at a part thereof that will become the joint face.

The connecting passage may be formed to extend over the plurality of exhaust passages to provide fluid communication among all of them. This makes it possible to inhibit occurrence of after fire, and clean the exhaust gas more effectively.

The exhaust passages may be arranged in close proximity with each other at downstream end portions thereof, and the connecting passage may be formed on a gasket disposed between the first joint face of the plurality of exhaust passages formed at the downstream end portions thereof and the second joint face joined to the first joint face. This makes it easy to form the connecting passage.

The connecting passage may be formed at upstream portions of the plurality of exhaust passages. This makes it possible to improve propagation efficiency of the flame propagating in the connecting passage.

The connecting passage may be formed between the exhaust passages corresponding to cylinders in which ignition occurs in a sequential order. This makes it possible to inhibit occurrence of after fire, and clean the exhaust gas more effectively.

The connecting passage may have a passage cross-sectional area that is in a range of approximately 1% to approximately 7% of a passage cross-sectional area of each of the plurality of exhaust passages. In this range of the cross-sectional area, the connecting passage is capable of propagating the flame and does not substantially affect the exhaust inertia between the exhaust passages.

The exhaust collecting passage may include a primary exhaust collecting passage into which two of four exhaust passages respectively extending from exhaust ports of four cylinders in the multi-cylinder engine are collected; and a secondary exhaust collecting passage located downstream of the primary exhaust collecting passages, into which two primary exhaust collecting passages are collected. In this structure, the advantages of the present invention are achieved more effectively.

Furthermore, in the personal watercraft including the water muffler located downstream of the secondary exhaust collecting passage, in which after fire is likely to occur, after fire can be effectively inhibited.

The exhaust collecting passage may include an exhaust manifold which is provided with a plurality of separate exhaust passages inside thereof and has a collecting pipe structure at a downstream end portion thereof into which the exhaust passages are arranged in close proximity with each other; and the exhaust collecting passage has at an upstream end portion thereof a collecting pipe structure conforming in shape to the downstream end portion of the exhaust manifold so as to be coupled to the downstream end portion of the exhaust manifold, and at a downstream end portion thereof a collecting passage structure in which the exhaust passages are collected into a common exhaust passage. The connecting passage may be formed at a joint portion at which the exhaust manifold and the exhaust collecting pipe are joined to each other. In this construction, the connecting passage can be easily formed.

The above and further objects and features of the invention will more fully be apparent from the following detailed description with accompanying drawings.

DETAILED DESCRIPTION OF THE PREFERRED EMBODIMENTS

Hereinafter, embodiments of a personal watercraft of the present invention will be described with reference to the accompanying drawings.

Figure 1:
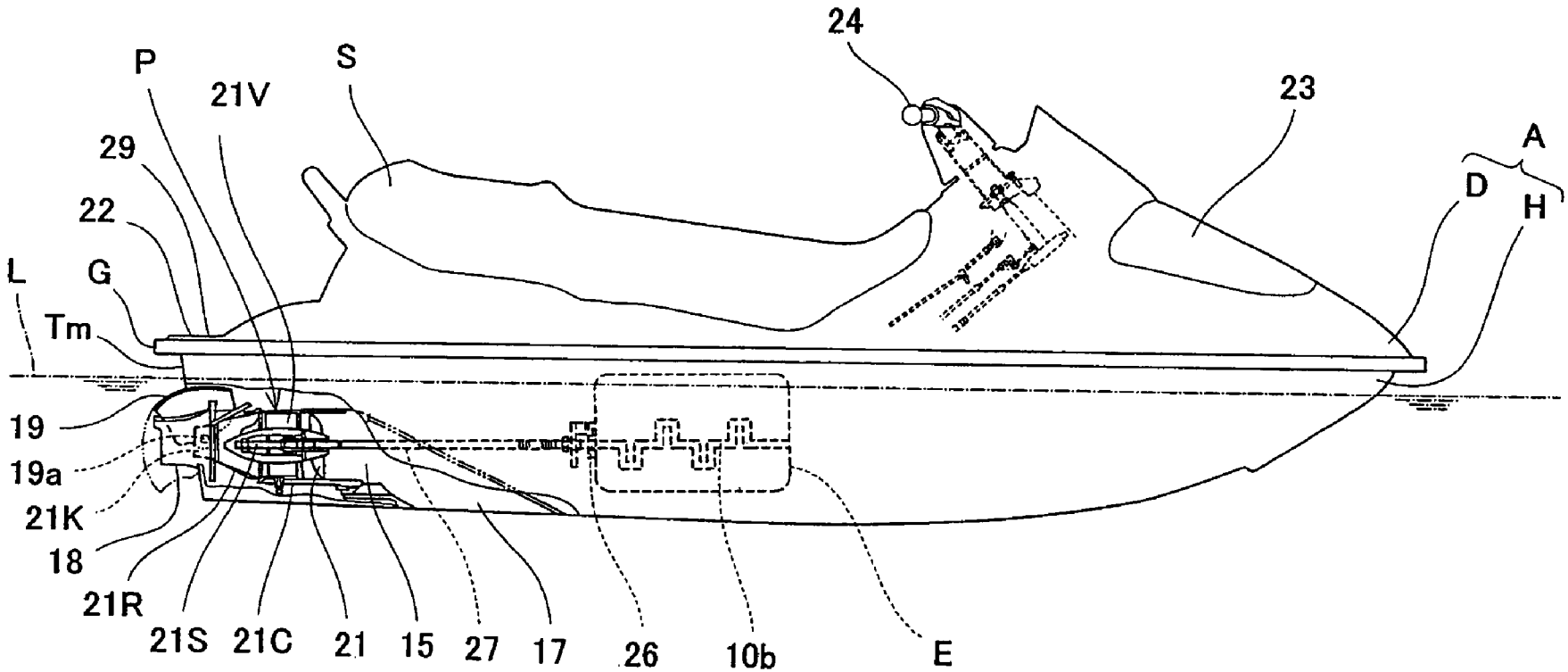
FIG. 1 is a side view of a personal watercraft equipped with a multi-cylinder engine according to an embodiment of the present invention.
Figure 2:
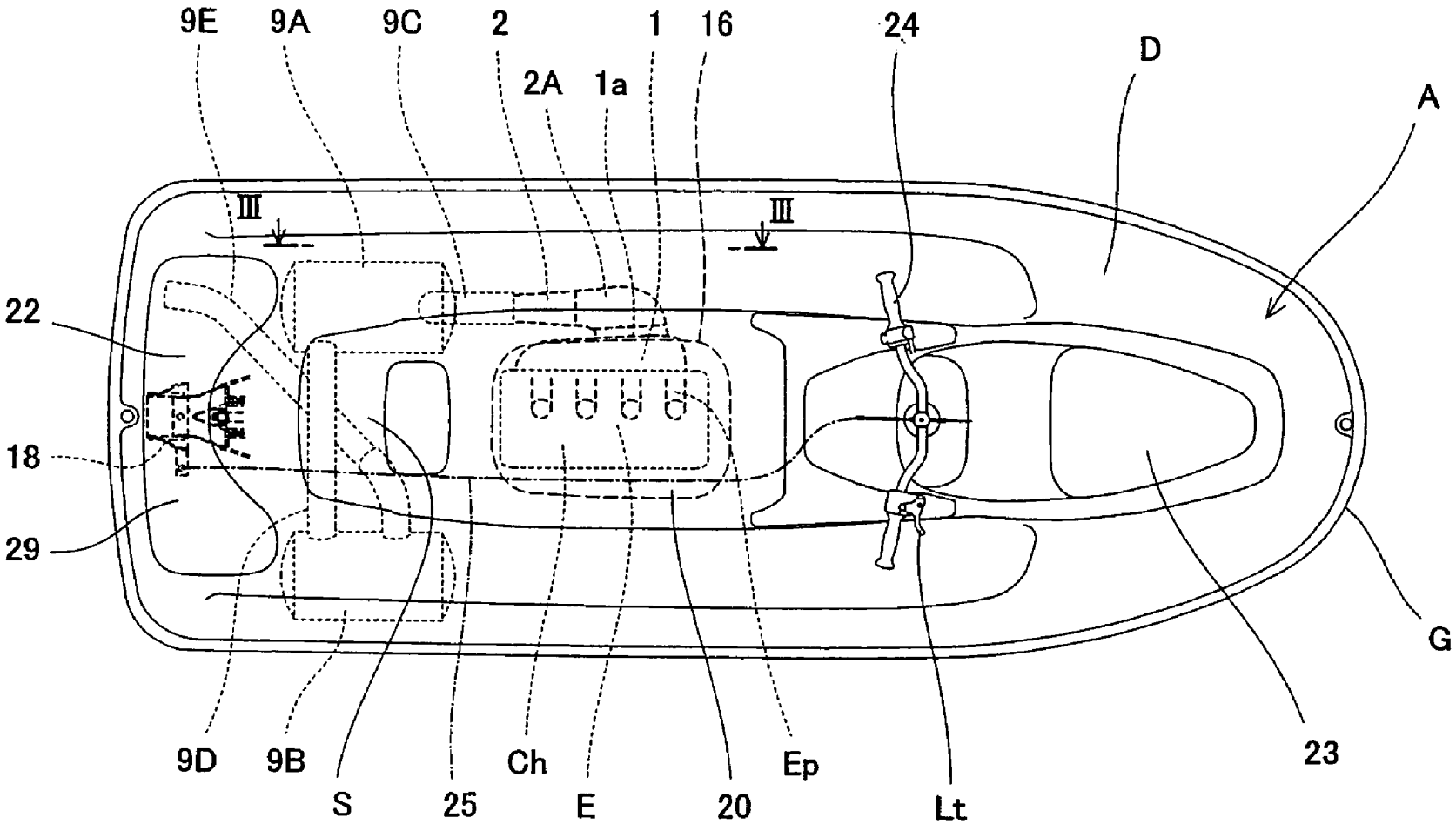
FIG. 2 is a plan view of the personal watercraft of FIG. 1.

In FIGS. 1 and 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends over an upper surface of the body A along the longitudinal direction of the body A, and a straddle seat S is mounted over the opening 16 such that it covers the opening 16 from above.

An engine E which is a drive unit for driving the watercraft is accommodated in a space 20 (see FIG. 2) defined by the hull H and the deck D below the seat S and having a convex-shape in a cross section of the body A.

In this embodiment, the engine E is a water-cooled four-cycle multi-cylinder (e.g., four-cylinder) engine. As shown in FIG. 1, the engine E is mounted such that a crankshaft 10*b* extends along the longitudinal direction of the body A. As shown in FIG. 1, an output end 26 of the crankshaft 10*b* is rotatably coupled integrally with a pump shaft of a water jet pump (propulsion pump) P which is a propulsion device, through a propeller shaft 27. An impeller 21 is mounted on the water jet pump P. The impeller 21 is covered with a pump casing 21C on the outer periphery thereof. A water intake 17 is provided on a bottom surface of the hull H. Water outside the watercraft is sucked from the water intake 17 and fed to the water jet pump P through a water passage 15. The water jet pump P pressurizes and accelerates the water. The pressurized and accelerated water is ejected through a pump nozzle (ejecting portion) 21R having a cross-sectional area of flow that is gradually reduced rearward, and from an outlet 21K provided at a rear end of the pump nozzle 21R, thereby obtaining a propulsion force for moving the watercraft.

In FIG. 1, reference numeral 21V denotes fairing vanes for guiding water flow inside the water jet pump P. As shown in FIGS. 1 and 2, reference numeral 24 denotes a bar-type steering handle. By operating the steering handle 24 to the right or to the left, the steering nozzle 18 provided behind the pump nozzle 21R is pivoted to the right or to the left via an operation cable 25 to enable the watercraft to be turned to any desired direction while the water jet pump P is generating the propulsion force. In FIG. 2, Lt denotes a throttle lever for controlling an engine speed of the engine E.

As shown in FIG. 1, a bowl-shaped reverse deflector 19 is provided above the rear side of the steering nozzle 18 such that it is pivotable downward around a horizontally mounted pivot shaft 19*a*. The deflector 19 is pivoted to a lower position behind the steering nozzle 18 to deflect the water ejected rearward from the steering nozzle 18 forward, and as the resulting reaction, the watercraft moves rearward.

In FIGS. 1 and 2, reference numeral 22 denotes a rear deck. The rear deck 22 is provided with an operable hatch cover 29. A storage compartment with a small capacity is provided under the hatch cover 29. In FIG. 1, reference numeral 23 denotes a front hatch cover. A storage compartment (not shown) is provided under the front hatch cover 23 for storing articles, tools and so on.

Figure 3:
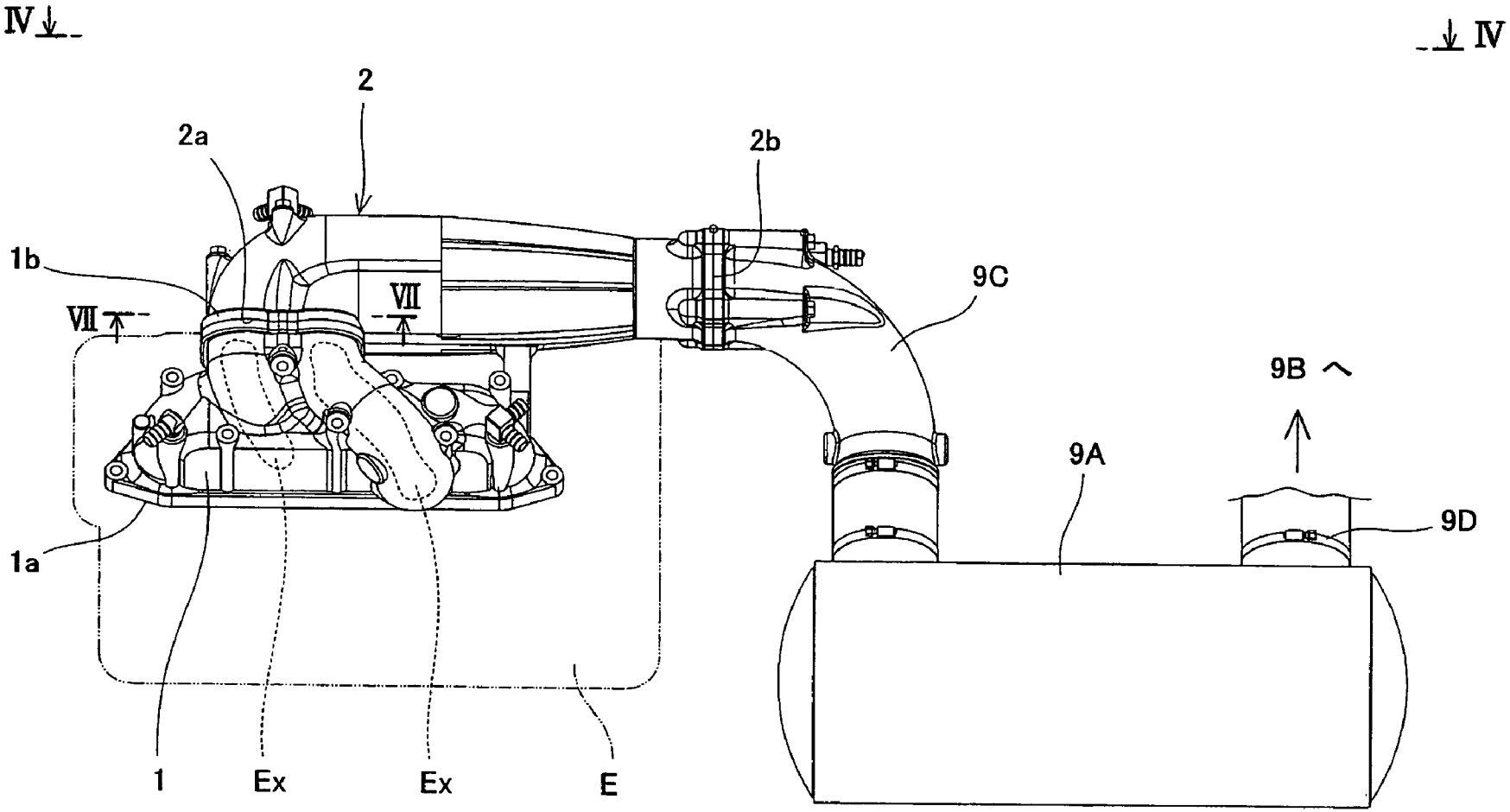
FIG. 3 is a side view taken in the direction of arrows substantially along line III-III of FIG. 2, showing exhaust passages provided in the multi-cylinder engine of the personal watercraft of FIG. 1 and an exhaust connecting pipe and a water muffler which are coupled to a downstream side of the exhaust passages.
Figure 6:
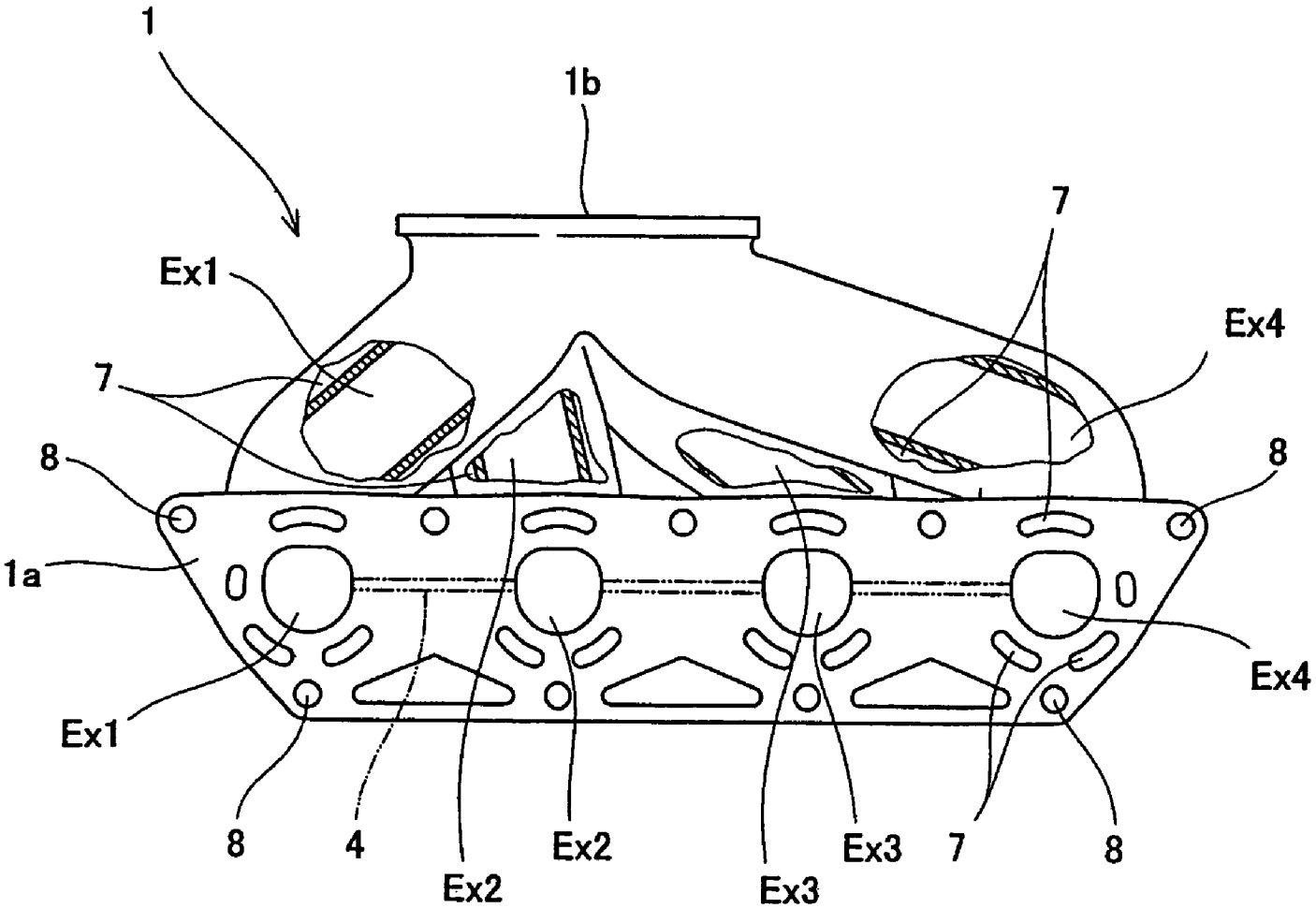
FIG. 6 is a view showing a joint face formed at an upstream end of the exhaust manifold.

As shown in FIG. 2, in the personal watercraft according to the embodiment of the present invention, a joint face 1*a* (see FIG. 6) at an upstream end of an exhaust manifold 1 in a flow direction of an exhaust gas is coupled to downstream ends of exhaust ports Ep of cylinders formed in a cylinder head Ch of the engine E. As shown in FIGS. 3 and 6, the exhaust manifold 1 has upstream portions of four exhaust passages Ex (respectively labeled as Ex1, Ex2, Ex3, and Ex4) configured to respectively discharge exhaust gases emitted from the cylinders. The exhaust manifold 1 has a downstream end portion configured to have a collecting pipe structure in which the exhaust passages Ex comprise the four exhaust passages Ex1, Ex2, Ex3, and Ex4, which are formed independently and positioned in close proximity with each other.

As shown in FIGS. 2 and 3, the exhaust passages Ex are arranged in close proximity with each other in the joint face 1*b* at the downstream end of the exhaust manifold 1 having the above described collecting pipe structure. As in the downstream end portion of the exhaust manifold 1, an upstream end portion of an exhaust collecting pipe 2 is configured to have a collecting pipe structure in which the exhaust passages Ex are arranged in close proximity with each other. A joint face 2*a* at an upstream end of the exhaust collecting pipe 2 is configured to conform to the joint face 1*b* at a downstream end of the exhaust manifold 1. The joint face 2*a* at the upstream end of the exhaust collecting pipe 2 is coupled to the joint face 1*b* at the downstream end of the exhaust manifold 1. By coupling the joint face 2*a* to the joint face 1*b* in this manner, the exhaust passages Ex are independently provided inside a coupling part.

By coupling the joint face 1*b* to the joint face 2*a* as described above, the exhaust passages Ex (Ex1, Ex2, Ex3, Ex4: see FIG. 5) are formed to respectively extend from the exhaust ports Ep to the upstream portions of the exhaust collecting pipe 2 via the exhaust manifold 1. The joint faces of the exhaust passages Ex, i.e., the joint face 1*b* of the exhaust manifold 1 and the joint face 2*a* of the exhaust collecting pipe 2 form an angle with respect to the longitudinal direction of the exhaust passages Ex, for example, approximately 90 degrees in this embodiment.

Figure 5:
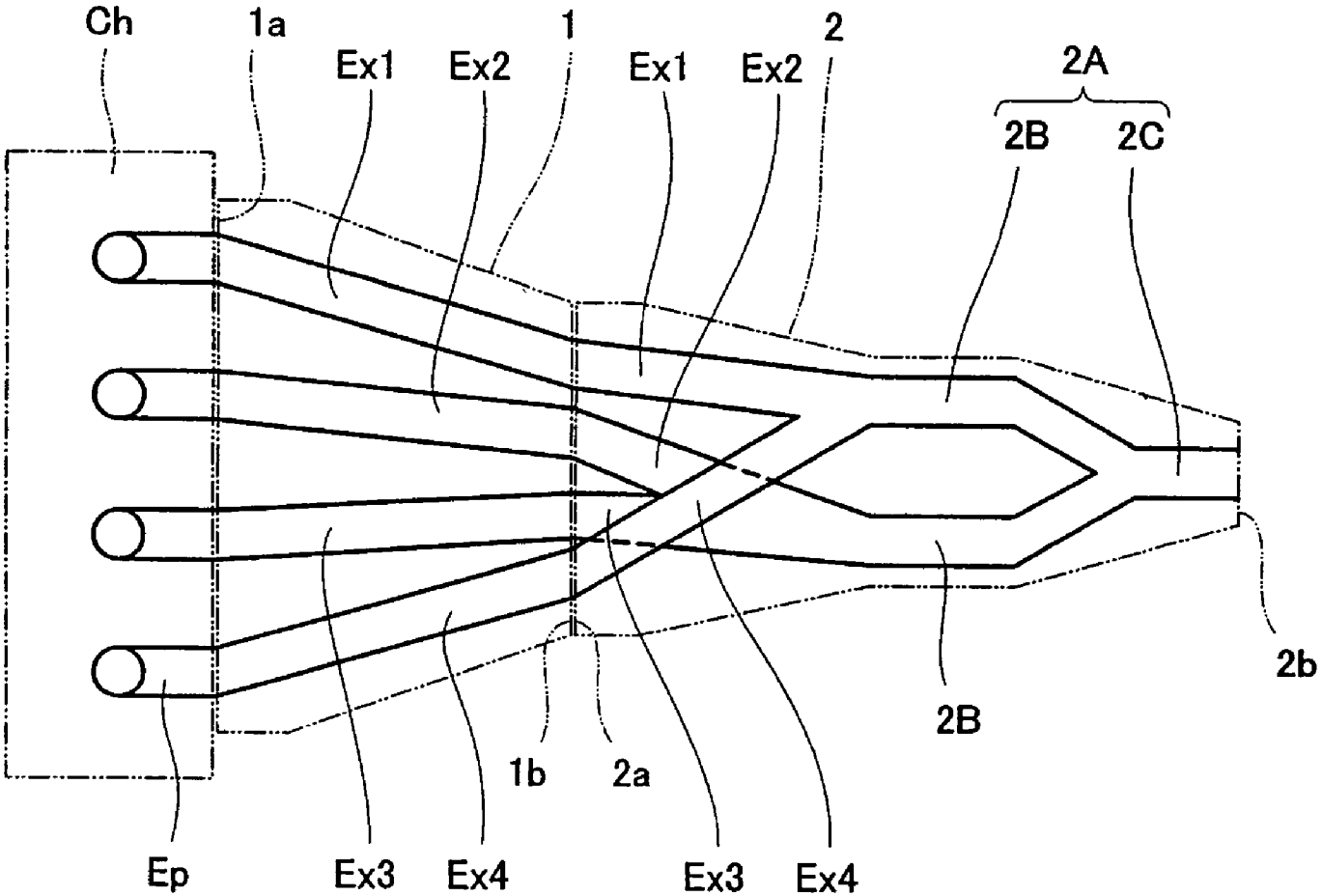
FIG. 5 is a view schematically showing a configuration to collect exhaust passages in the exhaust collecting system.
Figure 7:
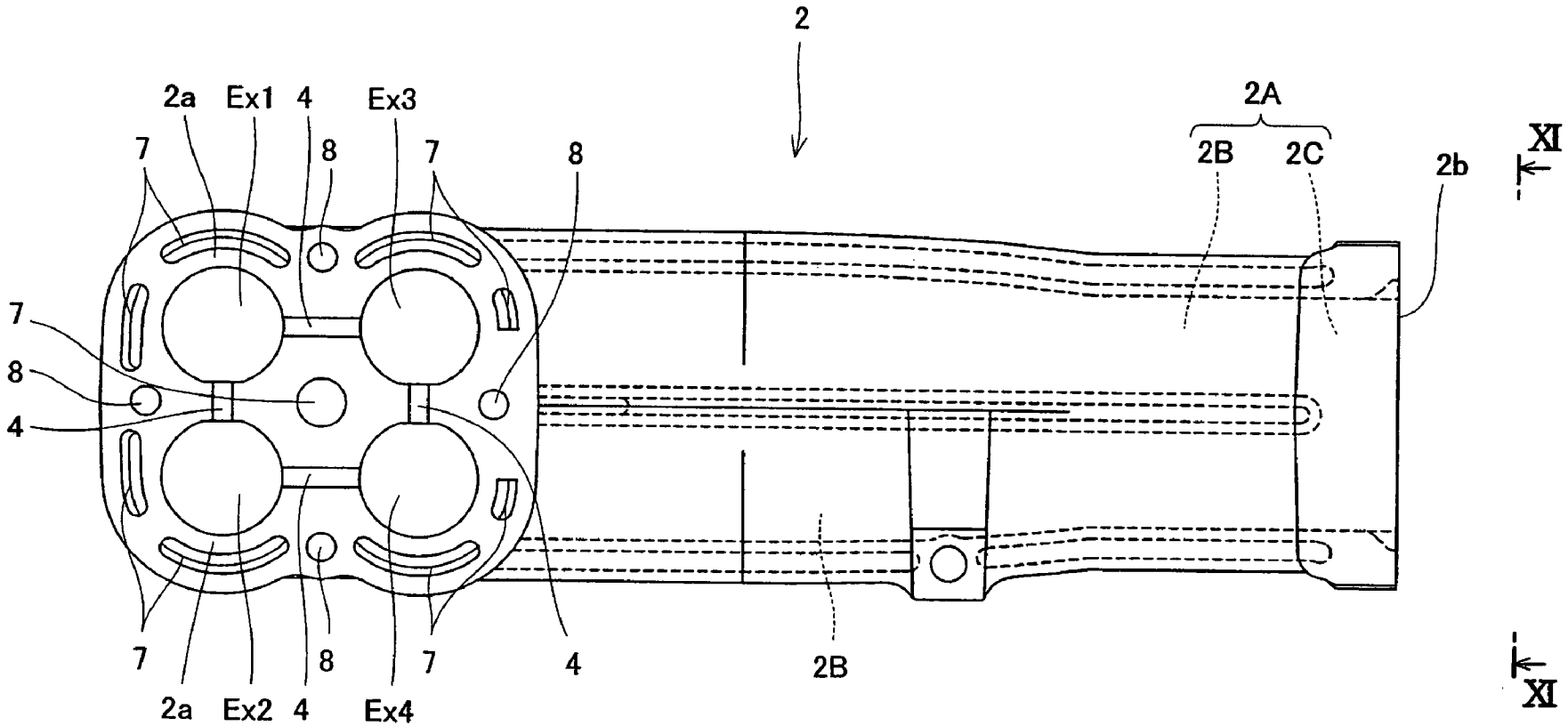
FIG. 7 is a view taken in the direction of arrows substantially along line VII-VII of FIG. 3, showing a structure of the exhaust collecting pipe of FIG. 3 and connecting passages formed at a joint face thereof.

As shown in FIG. 7, the exhaust collecting pipe 2 has at a downstream end portion thereof an exhaust collecting passage 2A configured to collect the plurality of exhaust passages Ex1, Ex2, Ex3, and Ex4 formed on upstream side into a common exhaust passage (secondary exhaust collecting passage) 2C, i.e., one exhaust passage in this embodiment (see FIG. 1). As shown in FIG. 5, within the exhaust collecting pipe 2, two of the four exhaust passages Ex1, Ex2, Ex3, and Ex4 are collected into a primary exhaust collecting passage 2B, and the exhaust collecting passage 2A is configured to collect two of the primary exhaust collecting passages 2B into the common exhaust passage 2C at a downstream side. More specifically, in this embodiment, the exhaust passages Ex1 and Ex4 are collected into the primary exhaust collecting passage 2B and the exhaust passages Ex2 and Ex3 are collected into the primary exhaust collecting passage 2B, and these two primary exhaust collecting passages 2B are collected into one common exhaust passage 2C at downstream side.

As shown in FIG. 5, the exhaust ports Ep, the exhaust manifold 1, and the exhaust collecting pipe 2 form an exhaust system in which the four exhaust passages Ex are collected into two exhaust passages which are in turn collected into one exhaust passage.

The exhaust passages Ex, the primary exhaust collecting passages 2B, and the common exhaust passage 2C are respectively provided at their outer peripheries with water jackets (cooling water passages: see FIGS. 6 and 7) through which cooling water for cooling the exhaust gas flows.

As shown in FIGS. 2 to 4, and 7, a downstream end 2*b* of the exhaust collecting pipe 2 is coupled to a first water muffler 9A disposed at a left bow of the watercraft via a first coupling pipe 9C having a single exhaust passage.

Figure 4:
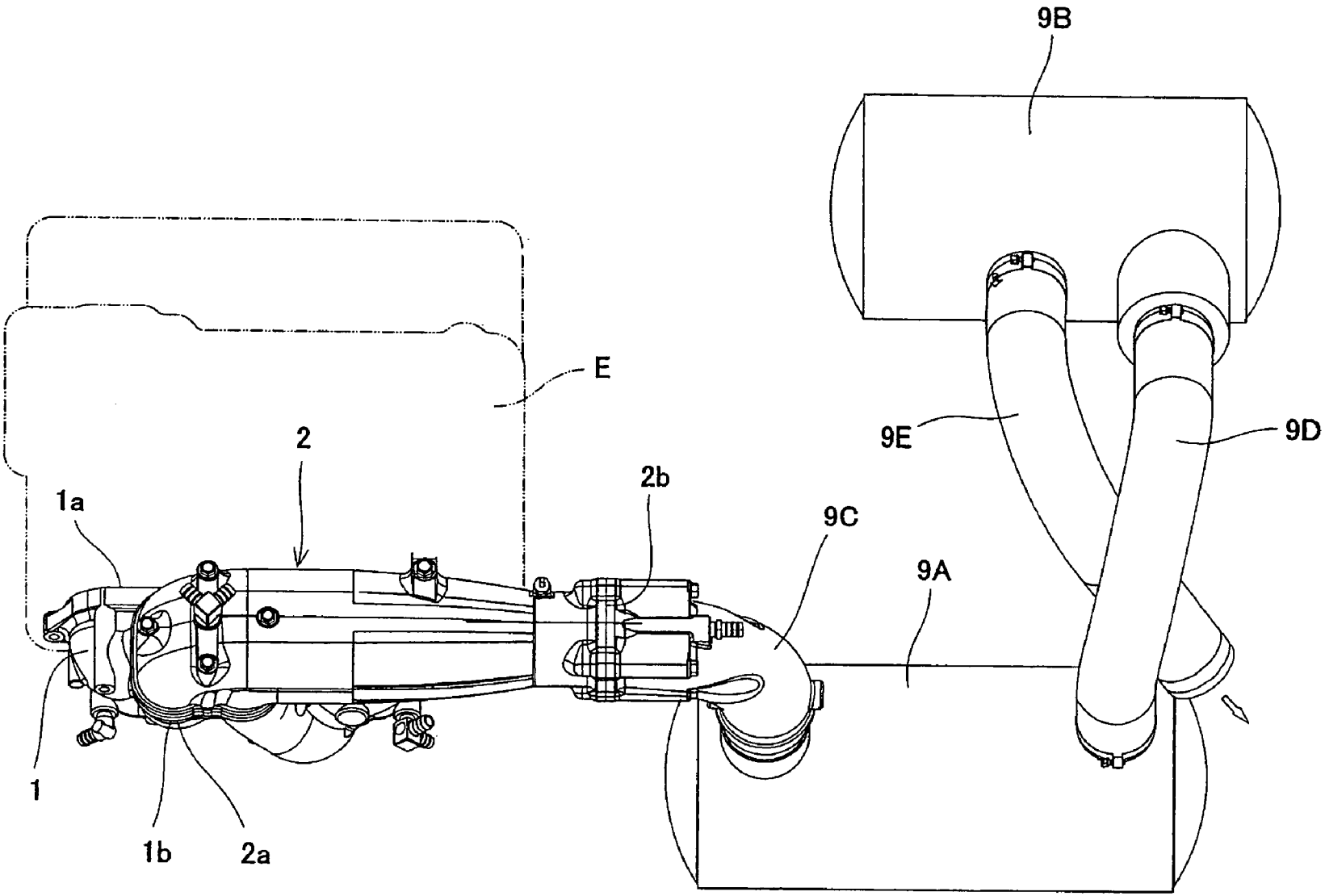
FIG. 4 is a plan view taken in the direction of arrows substantially along line IV-IV of FIG. 3, showing an exhaust manifold, and the exhaust collecting pipe and the water muffler which are coupled to a downstream side of the exhaust manifold.

As shown in FIG. 4, the first water muffler 9A is coupled to a second water muffler 9B disposed at a right bow of the watercraft via a second coupling pipe 9D. An exhaust pipe 9E is coupled at an upstream end thereof to the second water muffler 9B and extends rearward. A downstream end of the exhaust pipe 9E is disposed to face an opening (not shown) formed on a transom board Tm (see FIG. 1) of the watercraft so that the exhaust gas is discharged outside the watercraft from a stem, i.e., transom board.

As shown in FIG. 7, connecting passages 4 comprised of concave grooves through which the exhaust passages Ex fluidly communicate with each other are formed on one of the joint face 1*b* of the exhaust manifold 1 and the joint face 2*a* of the exhaust collecting pipe 2, in this embodiment, the joint face 2*a* of the connecting exhaust pipe 2. To be specific, ignition takes place in the following order: first cylinder, second cylinder, fourth cylinder, and third cylinder, and two exhaust passages of the exhaust passages Ex configured to open in the joint face 2*a*, which are sequential in the ignition order are connected to each other via the connecting passage 4, that is, connection is formed via the connecting passages 4 between the exhaust passages Ex1 and the Ex3 respectively corresponding to the first and third cylinders, the exhaust passages Ex3 and the Ex4 respectively corresponding to the third and fourth cylinders, the exhaust passages Ex4 and the Ex2 respectively corresponding to the fourth and second cylinders, and the exhaust passages Ex2 and the Ex1 respectively corresponding to the second and first cylinders. In the engine E, ignition takes place in the cylinders at intervals of 180 degrees in crank angle.

Each connecting passage 4 has a passage cross-sectional area that is equal to about 1% to 7%, preferably about 2% to 4% of a passage cross-sectional area of each exhaust passage Ex. In this embodiment, the cross-sectional area of each connecting passage 4 is set to about 3%. To facilitate propagation of flame, the cross-sectional area of each connecting passage 4 is 10 to 20 square millimeters. This is merely exemplary, and the cross-sectional area may be in a range of 8 to 35 square millimeters, preferably approximately 15 square millimeters. These numeric values are suitably determined depending on various conditions including a type of a fuel, a structure of the exhaust system, a position of the connecting passage 4 in the exhaust passage Ex, and so on.

Each connecting passage 4 allows the flame in the exhaust gas to propagate to its adjacent exhaust passage Ex, and its cross-sectional area is sized not to substantially affect a flow of the exhaust gas flowing in each exhaust passage Ex, namely, exhausting inertia. For this reason, the position of the connecting passage 4 in the longitudinal direction of the associated exhaust passage Ex may be determined without considering the exhausting inertia.

Figure 10:
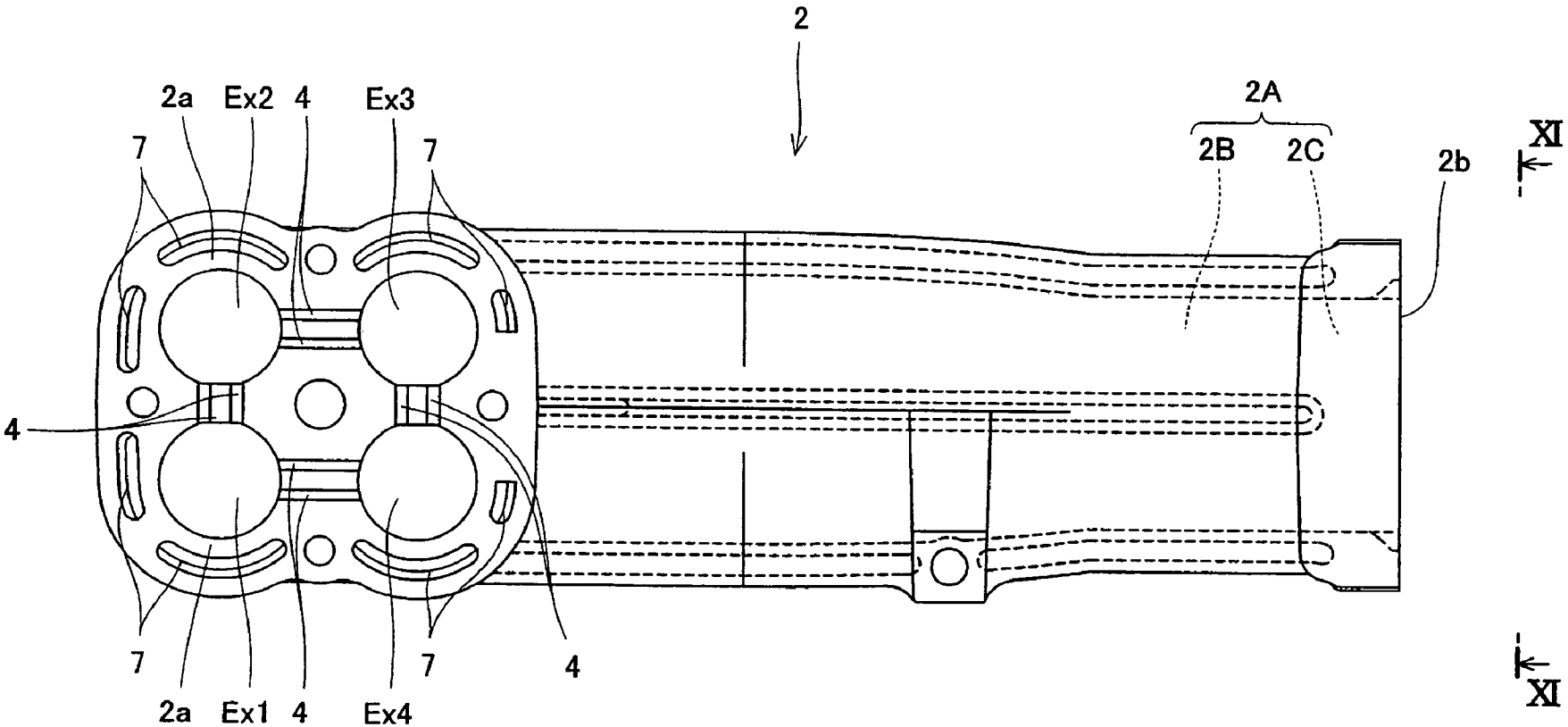
FIG. 10 is a view taken in the direction of arrows substantially along line VII-VII of FIG. 3, showing another structure of the exhaust collecting pipe and the connecting passages formed at the joint face thereof.
Figure 11:
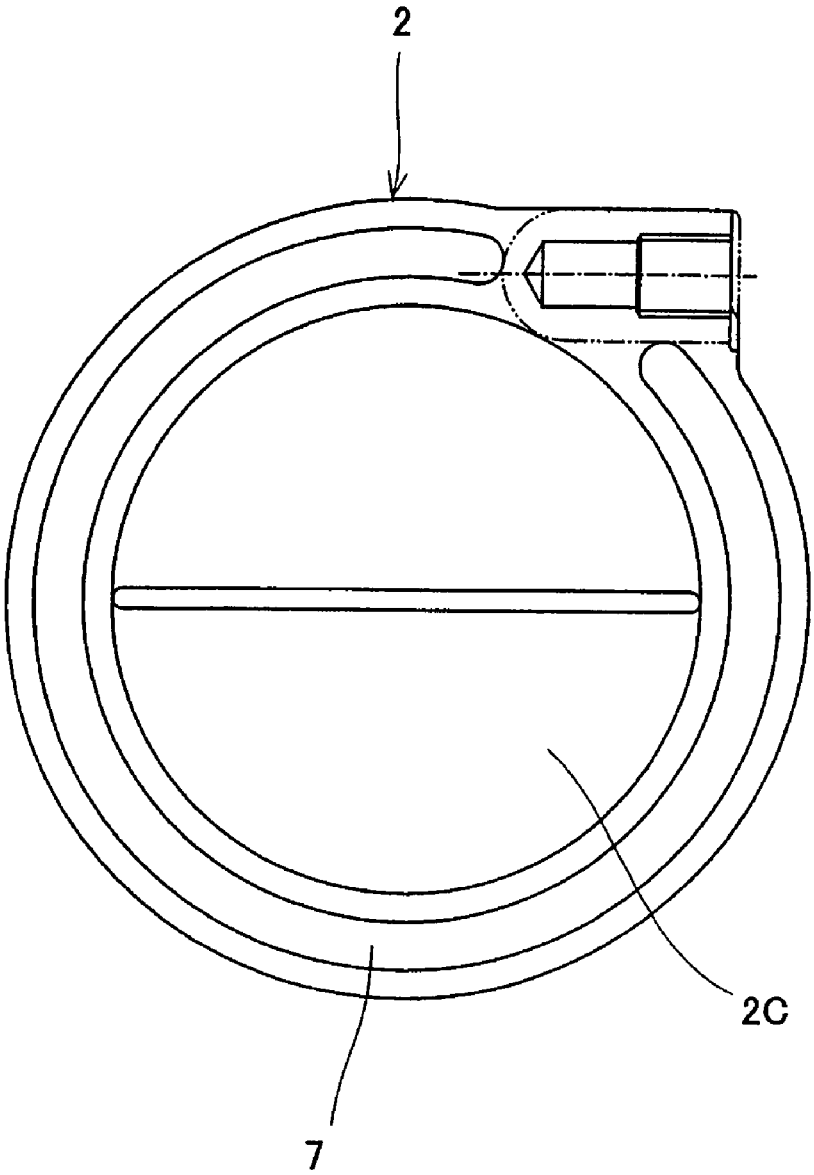
FIG. 11 is a view taken in the direction of arrows substantially along line XI-XI of FIGS. 7, 8, and 10, showing a structure of a connecting end face of a downstream end of the exhaust collecting pipe shown of FIGS. 7, 8, and 10.

Alternatively, as shown in FIG. 10, a plurality of connecting passages 4 may be formed between the exhaust passages Ex. When the plurality of connecting passages 4 are formed between the exhaust passages Ex in this way, it is necessary that a total of cross-sectional areas of the plurality of connecting passages 4 be set to be within the range of the above described passage cross-sectional area and each connecting passage 4 have a passage cross-sectional area sufficiently large to propagate the flame.

Figure 8:
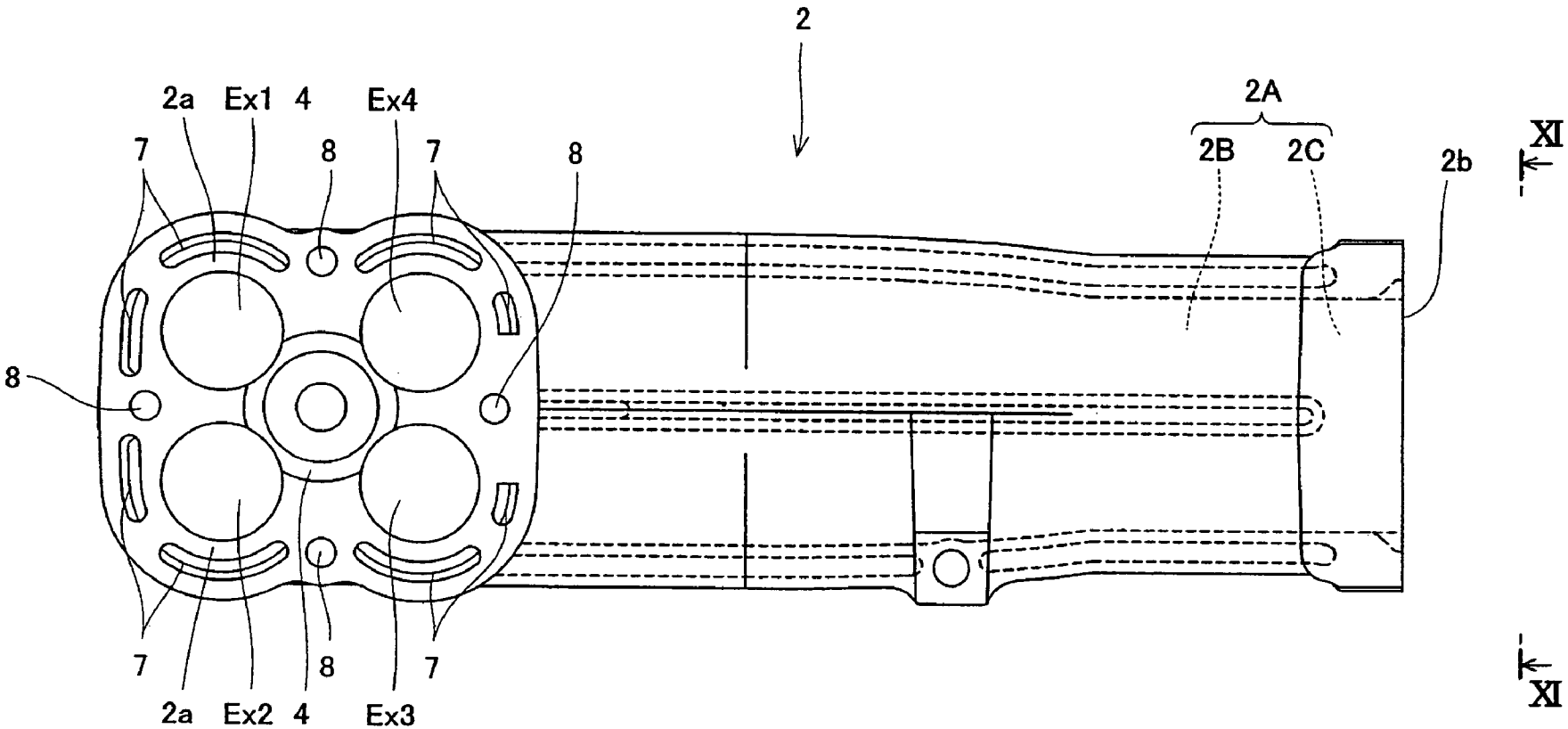
FIG. 8 is a view taken in the direction of arrows substantially along line VII-VII of FIG. 3, showing another structure of the exhaust collecting pipe and the connecting passages formed at the joint face thereof.

In a further alternative, as shown in FIG. 8, the connecting passage 4 may be formed to enable fluid communication among all the exhaust passages Ex1 to Ex4. In the example shown in FIG. 8, the connecting passage 4 is ring-shaped to connect the exhaust passages Ex1 to Ex4. As a matter of course, the connecting passage 4 may have other suitable shapes. To inhibit occurrence of after fire, the connecting passages 4 may be formed only between the exhaust passage Ex1 corresponding to the first cylinder and the exhaust passage Ex3 corresponding to the third cylinder, and between the exhaust passage Ex2 corresponding to the second cylinder and the exhaust passage Ex4 corresponding to the fourth cylinder, or otherwise between the exhaust passage Ex1 corresponding to the first cylinder and the exhaust passage Ex2 corresponding to the second cylinder, and the exhaust passage Ex3 corresponding to the third cylinder and the exhaust passage Ex4 corresponding to the fourth cylinder.

Figure 12A:
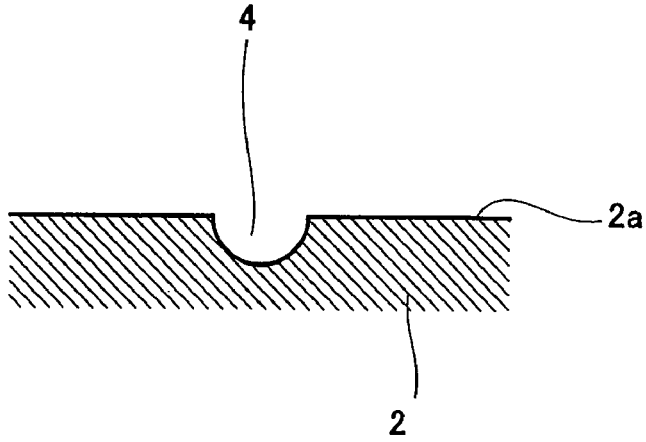
FIGS. 12A to 12C are enlarged views showing structures of a cross-section of the connecting passage formed on the joint face.
Figure 12B:
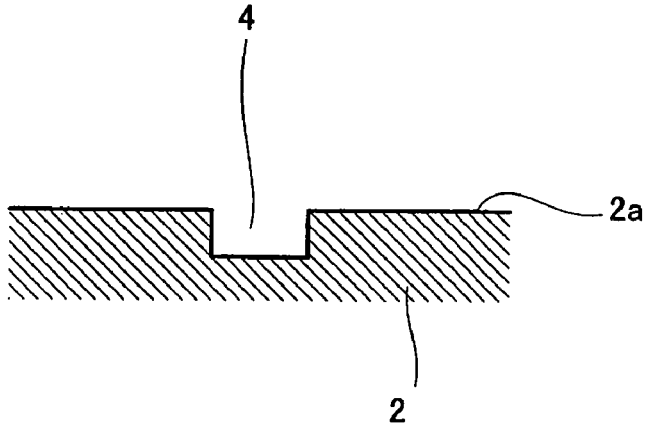
Figure 12C:
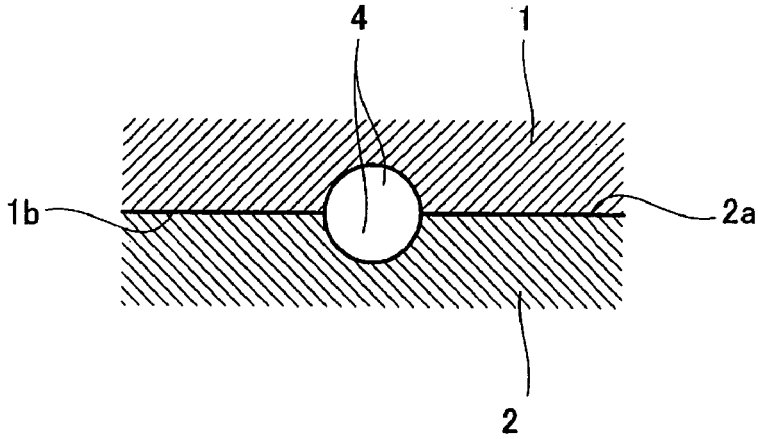

The connecting passage 4 is formed by the concave groove as described above. To be specific, a groove having a semicircular cross-section is formed on the joint face 2*a* as shown in FIG. 12A. Alternatively, the concave groove may be formed to have other shapes, for example, a rectangular shape as shown in FIG. 12B. In a further alternative, as shown in FIG. 12C, the connecting passage 4 may be comprised of a groove having a circular cross-section, which is formed by joining a groove formed on the joint face 2*a* having a semicircular cross-section and a groove formed on the joint face 1*b* having a semicircular cross-section.

Figure 9:
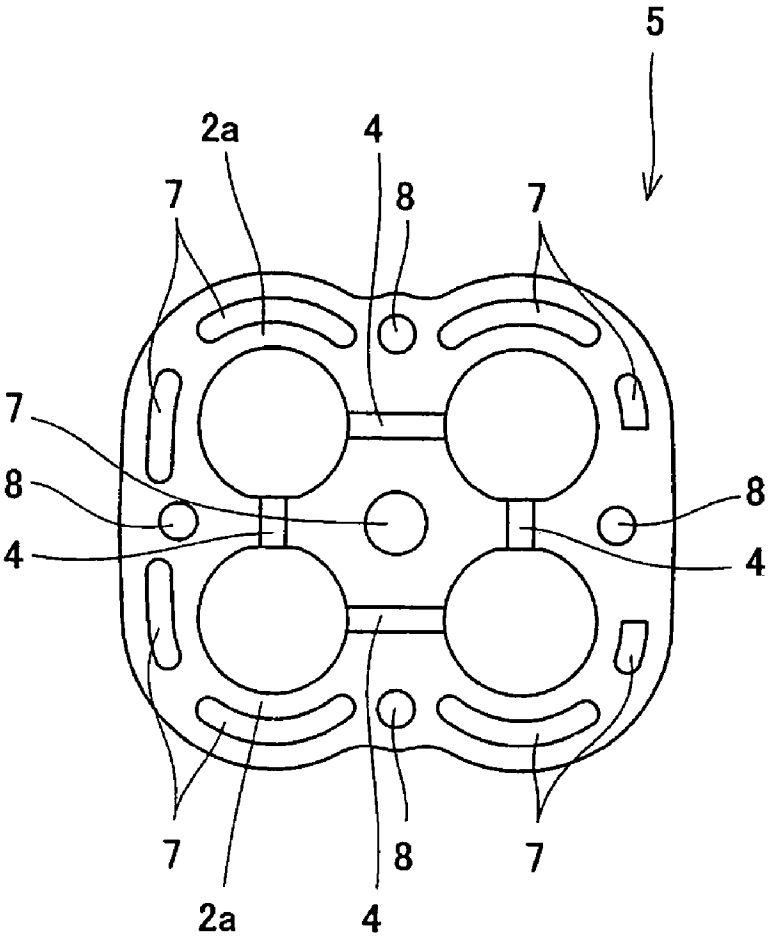
FIG. 9 is a view showing a structure of a gasket provided between a joint face of the exhaust manifold of FIGS. 3 and 4 and a joint face of the exhaust collecting pipe disposed downstream of the exhaust manifold, and a connecting passage formed on a surface of the gasket.

As shown in FIG. 9, the connecting passages 4 may be comprised of concave grooves formed on a surface of a gasket 5 disposed at an intermediate portion in the longitudinal direction of the exhaust passages Ex1, Ex2, Ex3, and Ex4, i.e., at the coupling portion between the exhaust manifold 1 and the exhaust collecting pipe 2 (between the joint face 1*b* and the joint face 2*a*), or may be formed inside the gasket 5, which is not shown. In FIGS. 6 to 10, 7 denotes cooling water passages and 8 denotes mounting bolt holes.

The connecting passages 4 may be formed at an upstream portion of the exhaust manifold 1, for example, at the upstream end 1*a* or in its vicinity as shown by two-dotted line of FIG. 6, or otherwise in an intermediate point of the exhaust passage Ex inside the exhaust manifold 1. In a further alternative, the connecting passages 4 may be formed within the exhaust ports Ep inside the cylinder head Ch.

Considering the intensity of the flame propagating in the connecting passage 4, it is desirable to position the connecting passages 4 at upstream portions of the exhaust passages Ex where the flame is intense. Or, it is desirable to position the connecting passages 4 at a region where the exhaust passages Ex are in close proximity with each other, because a distance between the exhaust passages Ex over which the flame propagates is shorter.

Figure 13:
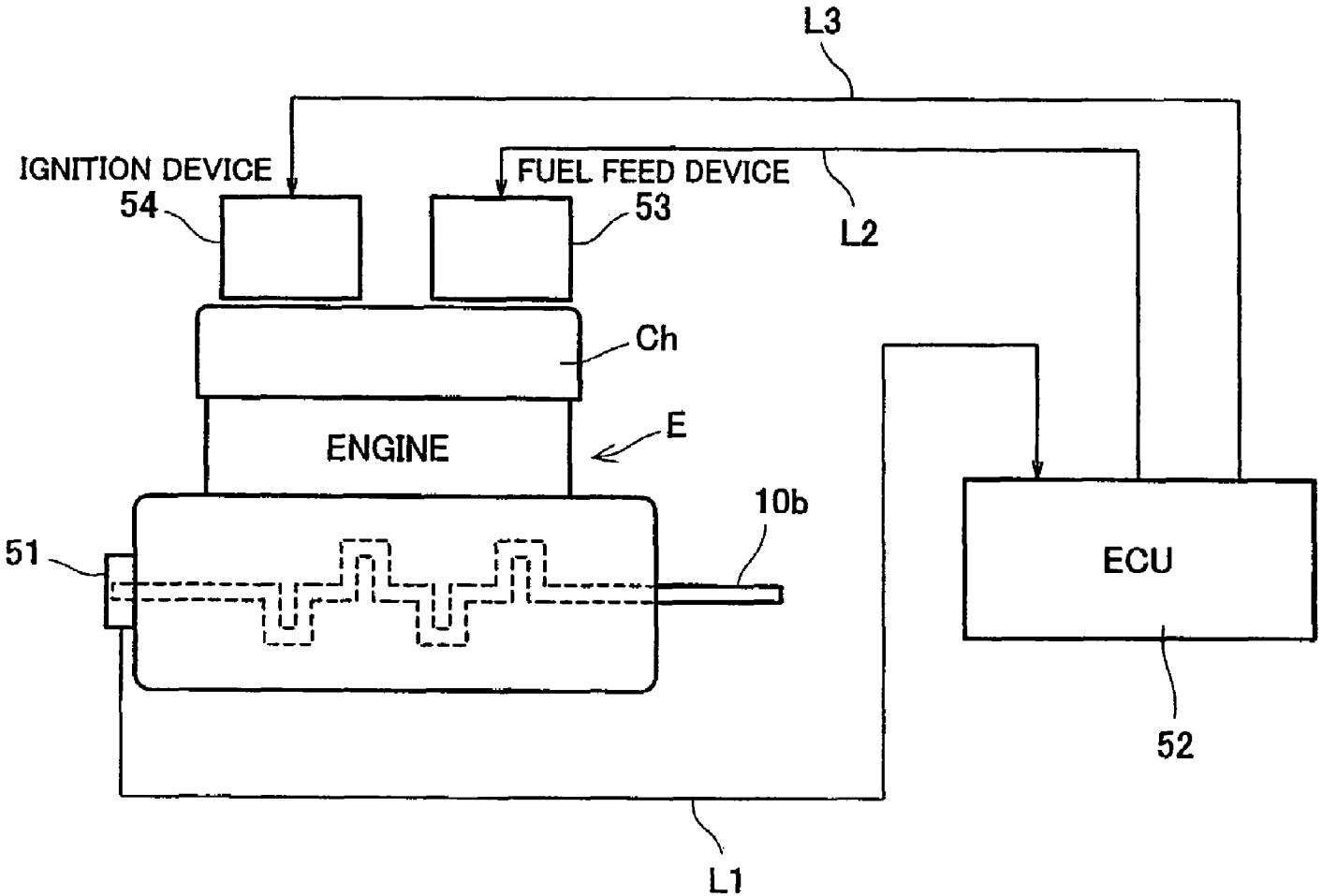
FIG. 13 is a block diagram showing a configuration of an over revolution inhibiting system for performing an over evolution inhibiting function of the engine of the personal watercraft of FIGS. 1 and 2.

As shown in FIG. 13, the engine E is equipped with an over revolution inhibiting system. The over revolution inhibiting system performs an over revolution inhibiting function as follows. When an engine speed of the engine E exceeds a predetermined value, for example, 9000 rpm, an engine speed sensor 51 attached to the crankshaft 10*b* of the engine E detects this and sends a signal associated with the engine speed to an engine control unit (ECU) 52 via a signal line L1. Receiving the signal, the ECU 52 sends a control signal to a fuel feed device (fuel injection device) 53 and an ignition device 54 via a signal line L2 and a signal line L3, respectively so that fuel feeding and ignition are omitted in one or two of the four cylinders. The fuel feeding and ignition may be omitted every time (on every crankshaft rotation), or once out of two or three times (once out of two or three crankshaft rotations), for example. Whereas both of the fuel feeding and the ignition are omitted in the over revolution inhibiting system in this embodiment, only one of the fuel feeding and ignition may be omitted.

In another embodiment, a control process of the over revolution inhibiting system may be changed according to a degree of the over revolution. For example, if the over revolution occurs significantly, then the fuel feeding and the ignition may be omitted in two cylinders once out of two crankshaft rotations. Also, if the over revolution occurs slightly, then the fuel feeding and the ignition may be omitted in one cylinder once out of three crankshaft rotations.

The personal watercraft configured as described above operates as follows. For example, when the water intake formed on the bottom surface of the hull H is exposed in air for a moment under the condition in which the engine E is running and the watercraft is skipping on the water surface, the over revolution may occur in the engine E because of a reduced load. In this case, when the engine speed of the engine E becomes a predetermined value, for example, 9000 rpm, the over revolution inhibiting system performs the over revolution inhibiting function. In this case, the ECU 52 controls the fuel feed device 53 and the ignition device 54 so that the fuel feeding and the ignition are omitted in one of the four cylinders of the engine E, for example. In this state, uncombusted gas may be in some cases emitted to the associated exhaust passage Ex from the cylinder in which the fuel feeding and the ignition have been omitted, and may be left therein. However, since the connecting passage 4 is formed between the exhaust passages Ex as described above, the exhaust gas is emitted from the cylinder in which ignition subsequently occurs, to the associated exhaust passage Ex and is propagated via the connecting passage 4 to the exhaust passage Ex in which the uncombusted exhaust gas exists, so that the uncombusted gas in the exhaust passage Ex is combusted relatively slowly with a flame in the exhaust gas being propagated. Thus, the uncombusted gas is prevented from flowing into the water mufflers 9A and 9B. As a result, after fire does not substantially occur in the water mufflers 9A and 9B. Even in the personal watercraft in which the water mufflers are equipped at a downstream end portion of the exhaust collecting system and after fire is likely to occur because of a back pressure (negative pressure) generated in the exhaust passages located upstream of the water mufflers, after fire can be effectively inhibited. Furthermore, the uncombusted gas is not discharged to outside the watercraft.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft equipped with a multi-cylinder engine including an exhaust collecting system configured to discharge an exhaust gas from the engine, the exhaust collecting system comprising:

a plurality of exhaust passages respectively corresponding to a plurality of cylinders provided in the multi-cylinder engine;

an exhaust collecting passage which is located downstream of the plurality of exhaust passages in a flow direction of the exhaust gas and is configured to collect the plurality of exhaust passages;

a water jacket formed at an outer peripheral region of each of the plurality of exhaust passages, for cooling the exhaust gas flowing in the exhaust passages; and a connecting passage configured to connect at least two of the plurality of exhaust passages and to propagate a flame into the exhaust gas, the flame in the exhaust gas being propagated via the connecting passage.

2. The personal watercraft according to claim 1, wherein the connecting passage is formed at upstream end portions of the plurality of exhaust passages.

3. The personal watercraft according to claim 1, wherein the connecting passage is formed between the exhaust passages corresponding to cylinders in which ignition occurs in a sequential order.

4. The personal watercraft according to claim 1, wherein the connecting passage has a passage cross-sectional area that is in a range of 1% to 7% of a passage cross-sectional area of each of the plurality of exhaust passages.

5. The personal watercraft according to claim 1, wherein the exhaust collecting passage includes a plurality of primary exhaust collecting passages into which two of four exhaust passages respectively extending from exhaust ports of four cylinders in the multi-cylinder engine are collected; and a secondary exhaust collecting passage located downstream of the primary exhaust collecting passages, into which two primary exhaust collecting passages are collected.

6. The personal watercraft according to claim 5, wherein the exhaust collecting system further includes a water muffler located downstream of the secondary exhaust collecting passage.

7. A personal watercraft equipped with a multi-cylinder engine including an exhaust collecting system configured to discharge an exhaust gas from the engine, the exhaust collecting system comprising:

a plurality of exhaust passages respectively corresponding to a plurality of cylinders provided in the multi-cylinder engine;

an exhaust collecting passage which is located downstream of the plurality of exhaust passages in a flow direction of the exhaust gas and is configured to collect the plurality of exhaust passages;

a water jacket formed at an outer peripheral region of each of the plurality of exhaust passages, for cooling the exhaust gas flowing in the exhaust passages; and a connecting passage configured to connect at least two of the plurality of exhaust passages;

wherein the plurality of exhaust passages are arranged in close proximity with each other at downstream end portions thereof, and the connecting passage is comprised of a groove formed on a first joint face of the plurality of exhaust passages formed at the downstream end portions thereof and a second joint face joined to the first joint face.

8. The personal watercraft according to claim 7, wherein the connecting passage is formed to extend over the plurality of exhaust passages to provide fluid communication among all of the plurality of exhaust passages.

9. A personal watercraft equipped with a multi-cylinder engine including an exhaust collecting system configured to discharge an exhaust gas from the engine, the exhaust collecting system comprising:

a plurality of exhaust passages respectively corresponding to a plurality of cylinders provided in the multi-cylinder engine;

an exhaust collecting passage which is located downstream of the plurality of exhaust passages in a flow direction of the exhaust gas and is configured to collect the plurality of exhaust passages;

a water jacket formed at an outer peripheral region of each of the plurality of exhaust passages, for cooling the exhaust gas flowing in the exhaust passages; and a connecting passage configured to connect at least two of the plurality of exhaust passages;

wherein the exhaust passages are arranged in close proximity with each other at downstream end portions thereof, and the connecting passage is formed on a gasket disposed between a first joint face of the plurality of exhaust passages formed at the downstream end portions thereof and a second joint face joined to the first joint face.

10. A personal watercraft equipped with a multi-cylinder engine including an exhaust collecting system configured to discharge an exhaust gas from the engine, the exhaust collecting system comprising:

a plurality of exhaust passages respectively corresponding to a plurality of cylinders provided in the multi-cylinder engine;

an exhaust collecting passage which is located downstream of the plurality of exhaust passages in a flow direction of the exhaust gas and is configured to collect the plurality of exhaust passages;

a water jacket formed at an outer peripheral region of each of the plurality of exhaust passages, for cooling the exhaust gas flowing in the exhaust passages; and a connecting passage configured to connect at least two of the plurality of exhaust passages;

wherein the exhaust passages compose exhaust manifold inside of which the plurality of exhaust passages are separately provided, and which forms at a downstream end portion thereof a collecting pipe structure into which the separate exhaust passages are arranged in close proximity with each other;

wherein the exhaust collecting passage has at an upstream end portion thereof a collecting pipe structure conforming in shape to the downstream end portion of the exhaust manifold so as to be coupled to the downstream end portion of the exhaust manifold, and at a downstream end portion thereof a collecting passage structure in which the exhaust passages are collected into a common exhaust passage; and wherein the connecting passage is formed at a joint portion at which the exhaust manifold and the exhaust collecting passage are joined to each other.

* * * * *